United States Patent [19]

Taggart

[11] 4,268,835

[45] May 19, 1981

[54] PARABOLIC REFLECTOR

[76] Inventor: Robert B. Taggart, 348 Ramona Rd., Portola Valley, Calif. 94025

[21] Appl. No.: 117,993

[22] Filed: Feb. 4, 1980

[51] Int. Cl.[3] ..... H01Q 15/16; H01Q 15/20

[52] U.S. Cl. ..... 343/915

[58] Field of Search ..... 343/912, 915, 840

[56] References Cited

U.S. PATENT DOCUMENTS 3,832,717 8/1974 Taggart ..... 343/915

3,971,023 7/1976 Taggart ..... 343/915

*Primary Examiner*—Eli Lieberman

*Attorney, Agent, or Firm*—F. D. LaRiviere

[57] ABSTRACT

A reflector for high gain antennae comprising a plurality of generally triangular shaped petals joined in edgewise overlapping relation, wherein the overlap gradually increases from rim to center of the reflector, so as to provide a mechanically stable paraboloid configuration. The petals are supported by a rigid rim structure constructed of preformed tubular sections.

4 Claims, 7 Drawing Figures

PARABOLIC REFLECTOR

BACKGROUND AND SUMMARY OF THE INVENTION

As reflector 10 of U.S. Pat. No. 3,971,023 is assembled as shown in FIG. 1, each petal 20 shown in FIGS. 2 and 3 tends to twist about its longitudinal axis, causing detectable surface irregularities at or near the center of the fully assembled reflector, in turn causing degradation of the antenna gain characteristic. Such irregularities can be overcome by adding support truss behind the assembled petals. However, the present invention overcomes the tendency of each petal to twist by providing a petal overlap which gradually increases from outer rim to center of the reflector. Heretofore, nominal rms surface deviation was achieved by providing many precisely sized and positioned holes in a large or full overlap region of adjacent petals.

As also shown in FIG. 1, U.S. Pat. Nos. 3,971,023 and 3,832,717, describe reflectors having a rigid, segmented exterior rim 12 formed to receive the outer edges of the petals, provide mechanical support for mounting and positioning the antenna, and maintain mechanical integrity over a wide range of environmental conditions. The rim segments 14 are extruded channel stock coupled to one another by angular corner brackets 16. Such rim structure is tedious to manufacture and cumbersome to assemble. The present invention provides a rim structure constructed of preformed tubular segments. Such tubular segments require no comer brackets and provide greater strength when assembled and are easier to manufacture and assemble than prior art rim assemblies.

DESCRIPTION OF THE PREFERRED EMBODIMENT

Figure 1:
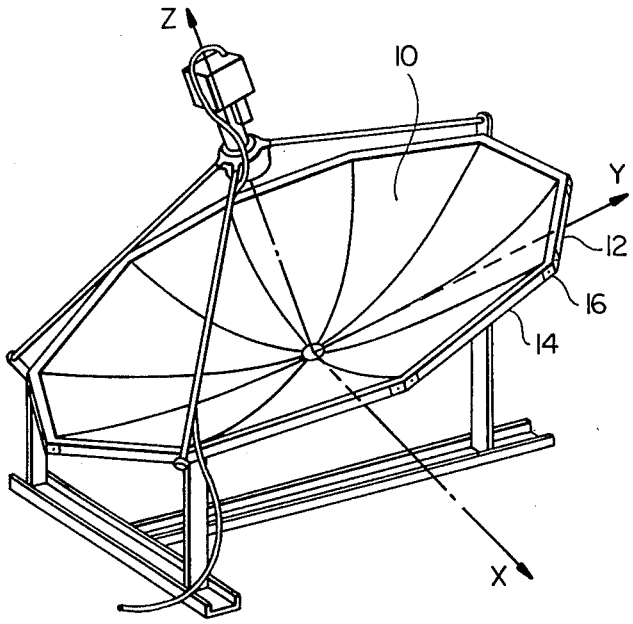
FIG 1 PRIOR ART
FIG. 1 is a perspective view of a microwave antenna incorporating the prior art paraboloid dish reflector and exterior rim structure.
Figure 2:
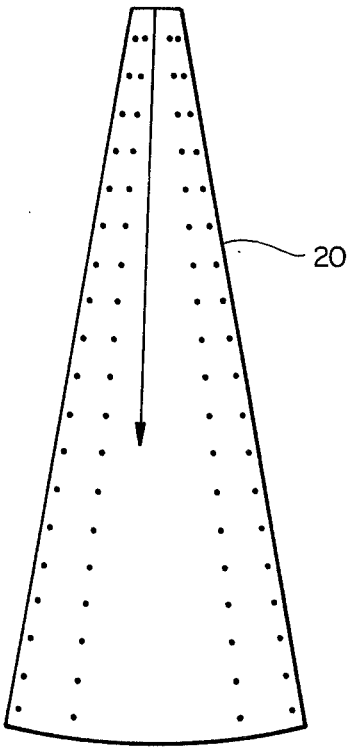
FIG 2 PRIOR ART
FIG. 2 is a top view of a reflector petal constructed according to the prior art.
Figure 3:
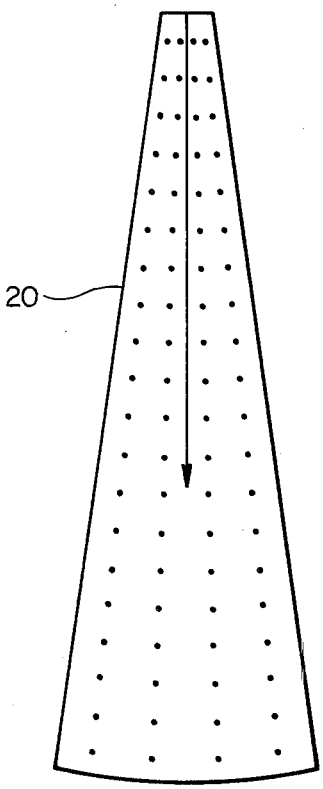
FIG 3 PRIOR ART
FIG. 3 is a top view of another reflector petal constructed according to the prior art.
Figure 4:
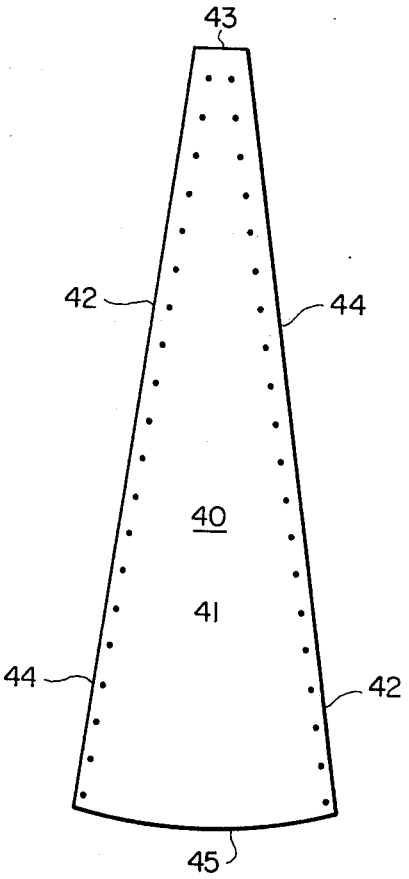
FIG. 4 is a top view of a reflector petal constructed according to the present invention.
Figure 5:
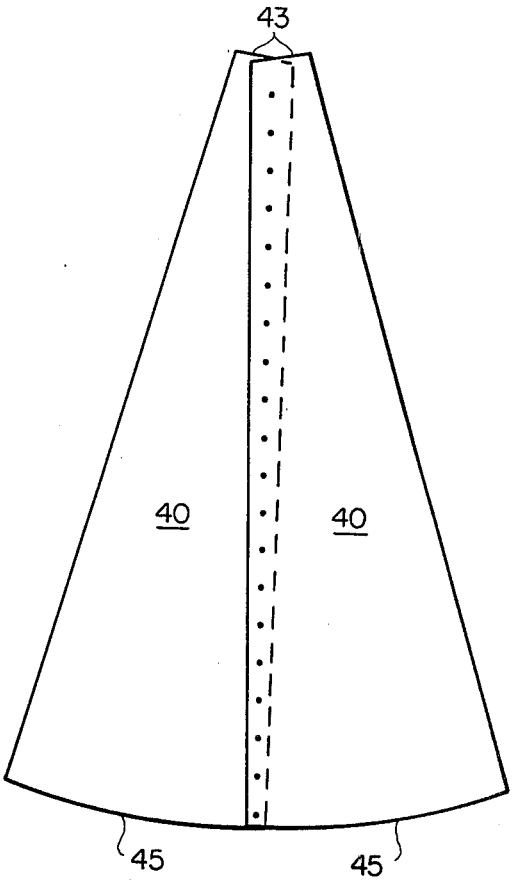
FIG. 5 is a top view of two of a plurality of adjacent petals assembled according to the present invention.

U.S. Pat. Nos. 3,971,023 and 3,832,717 are incorporated by reference as if fully set forth herein. Referring to FIG. 4 hereof, petal 40 is generally triangular shaped having longitudinal axis 41 and rectilinear longitudinal edges 42. Centerlines 44 locate the centers of the bolt holes for assembling adjacent petals. Centerlines 44, and therefore the bolt holes, are nearer edges 42 at wide end 45 than at narrow end 42. Since all petals have bolt holes similarly located with respect to the longitudinal edges thereof, the bolt holes determine the relative overlap of adjacent petals. Thus, the overlap of adjacent petals gradually increases from wide end 45 to narrow end 43 of each petal as shown in FIG. 5. Narrow end 43 of each petal is located at the center of the reflector when assembled, and wide end 45 is complete to the rim structure of the reflector.

Figure 6:
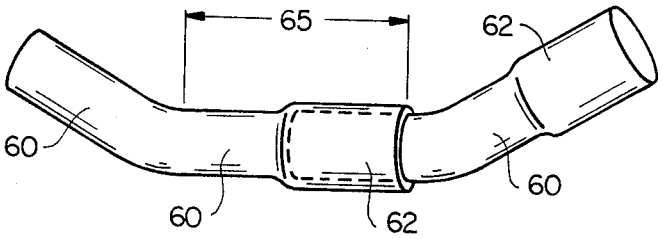
FIG. 6 is a top view of two of a plurality of adjacent rim segments assembled according to the present invention.
Figure 7:
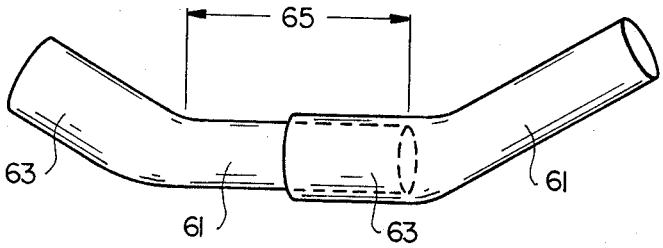
FIG. 7 is a top view of another configuration of a plurality of rim segments assembled according to the present invention.

Referring now to FIGS. 6 and 7, tubular rim segments 60 have two similar configurations. In one embodiment, rim segment 60 comprises a preselected length of metal pipe having enlarged or "flared" end 62. The inside diameter of flared end 62 is slightly greater than the outside diameter of the other end of another substantially identical length of the same or similar pipe. Pipe section 60 is bent to a preselected angle with respect to its longitudinal axis. The precise angle is determined by the number of petals comprising the reflector; for example, the angle is 22.5° for a reflector having 16 petals. The distance of the bend from the unflared end of the pipe section is determined by the length of the flared portion of the pipe section into which it will be inserted when assembled as shown in FIG. 6.

Similarly, in the embodiment shown in FIG. 7, rim segment 61 comprises a length of pipe having a bend to a preselected angle nearest flared end 63. In this embodiment the length of the enlarged diameter of flared end 63 also determines the location of the bend. Again the precise angle is determined by the number of petals comprising the reflector.

It should be noted that the distance between bends of a fully assembled rim structure is approximately equal to the width of wide end 45 of each petal. The rim structure should be assembled on a flat surface to assure uniform mechanical reference for assembly of the petals. Each tubular segment may be coupled to one another by bolts or by welding or any other fastening means which provides structural rigidity.

Of course rim segments 60 and 61 may be constructed of any inelastic generally tubular in material, including polyvinylchloride (PVC) pipe, suitable for supporting the reflector petals in the range of environmental conditions expected. Petals 40, as well as other structural parts of the reflector, may be constructed and assembled as described in U.S. Pat. Nos. 3,971,023 and 3,832,717.

I claim:

1. In a reflector for high-gain antennae having a plurality of generally planar, triangular electromagnetically reflection petals having a longitudinal axis and rectilinear longitudinal edges, means for connecting adjacent petals in longitudinal edgewise overlapping relation through holes therein at predetermined locations to form a reflector having the shape of a surface of revolution, each petal taking the form along its longitudinal axis of the line that generates the surface of revolutions and having generally curvilinear transverse form, the improvement comprising gradually increasing the overlap of adjacent petals from rim to center of the reflector.

2. In the reflector of claim 1, the improvement further including holes located along a rectilinear centerline nearer the longitudinal edges of the petals at the wide end thereof than at the narrow end thereof.

3. In the reflector of claims 1 or 2, the improvement further including a segmented, tubular rigid rim coupled to the wide ends of the petals, each tubular rim segment being bent to a preselected angle determined by the number of petals.

4. In the reflector of claim 3, the improvement further including tubular rim segment having an enlarged end to receive the other end of a substantially identical tubular rim segment.

* * * * *